US008578612B2

(12) United States Patent
Doane

(10) Patent No.: US 8,578,612 B2
(45) Date of Patent: Nov. 12, 2013

(54) REVERSE ACTUATED NAIL CLIPPER

(76) Inventor: Michael Patrick Doane, Falls Church, VA (US)

( * ) Notice: Subject to any disclaimer, the term of this patent is extended or adjusted under 35 U.S.C. 154(b) by 0 days.

(21) Appl. No.: 13/195,804

(22) Filed: Aug. 1, 2011

(65) Prior Publication Data

US 2013/0212884 A1 Aug. 22, 2013

(51) Int. Cl.
*A45D 29/02* (2006.01)

(52) U.S. Cl.
USPC ..... 30/28; 30/26

(58) Field of Classification Search
USPC ..... 30/28, 26, 120.5
See application file for complete search history.

(56) References Cited

U.S. PATENT DOCUMENTS

| | | | | | |
|---|---|---|---|---|---|
| 741,709 | A * | 10/1903 | Petrelli | 30/28 |
| 846,924 | A * | 3/1907 | Kamppe | 132/75.5 |
| 1,394,727 | A * | 10/1921 | Gronbech | 30/28 |
| 3,316,632 | A * | 5/1967 | Bowers | 30/28 |
| 3,555,675 | A * | 1/1971 | Jurena | 30/28 |
| 3,744,131 | A * | 7/1973 | Manes | 30/28 |
| 4,641,430 | A * | 2/1987 | Hahn | 30/120.5 |
| 4,648,415 | A * | 3/1987 | Yuan | 132/73 |
| 4,856,190 | A * | 8/1989 | Reiswig | 30/29 |
| 5,392,518 | A * | 2/1995 | Means | 30/28 |
| 5,522,136 | A * | 6/1996 | Larisey | 30/28 |
| 5,557,849 | A * | 9/1996 | Lee et al. | 30/29 |
| 6,735,869 | B2 * | 5/2004 | Lau | 30/28 |
| 7,234,238 | B2 * | 6/2007 | Wong | 30/28 |
| 7,530,170 | B2 * | 5/2009 | Shackelford | 30/28 |
| 8,356,414 | B2 * | 1/2013 | Wendorf et al. | 30/26 |
| 2007/0017096 | A1 * | 1/2007 | Shackelford | 30/28 |
| 2008/0168656 | A1 * | 7/2008 | Cho | 30/28 |
| 2010/0132727 | A1 * | 6/2010 | Franklin | 132/75.5 |
| 2011/0005537 | A1 * | 1/2011 | Hsu | 132/73.5 |
| 2011/0154667 | A1 * | 6/2011 | Farris | 30/28 |

* cited by examiner

*Primary Examiner* — Sean Michalski

(57) ABSTRACT

A device for clipping fingernails and toenails of human beings that differs from other nail clippers by reversing the end of the clipper on which a user presses to perform nail clipping. Instead of the user pressing down on the end opposite the nail clipper's cutting edges, the current invention allows the user to press down directly above the clipper's cutting edges. This lever reversal makes the nail clipper easier to use while also giving the user greater control and accuracy, which is the object of the invention.

The invention is an extension of traditional nail clippers in that it adds a second lever assembly that pivots on a hinge located at the end of a common art nail clipper, opposite the end having the cutting edges. The user presses on the free end of the second lever assembly to operate the nail clipper.

3 Claims, 4 Drawing Sheets

REVERSE ACTUATED NAIL CLIPPER

References Cited
U.S. PATENT DOCUMENTS

| | | | |
|---|---|---|---|
| 741,709 | October 1903 | Petrelli | 30/28, 30/188 |
| 2,570,025 | December 1948 | Davis | 30/28 |
| 4,176,449 | December 1979 | Lee, Lee | 30/28 |
| 4,640,011 | February 1987 | Gamble | 30/28 |
| 5,226,849 | July 1993 | Johnson | 30/28 |
| 5,392,518 | February 1995 | Means | 30/28 |
| 5,522,136 | June 1996 | Larisey | 30/28 |
| 6,705,014 B2 | March 2004 | Park | 30/28 |
| 6,735,869 B2 | May 2004 | Lau | 30/28 |
| 7,234,238 B2 | June 2007 | Wong | 30/28 |
| 7,530,170 B2 | May 2009 | Shackelford | 30/28 |

BACKGROUND OF THE INVENTION

1. Field of the Invention

The invention relates to a nail clipper for clipping the fingernails or toenails of human beings in a manner that makes it easier to control where the cutting edges are positioned prior to clipping and remain positioned during the clipping. The user actuates the invention's clipping operation by applying pressure between the thumb and forefinger directly above and below the clipper's cutting edges such that there is no resultant force that might cause the cutting edges to move from the desired position for cutting the user's nail.

2. Description of Related Art

Various nail clippers have been provided that all perform the basic clipping operation. They are primarily comprised of the cutting arm springs joined together at one end and having slightly separated and opposing cutting edges on their other end. Some of these designs are U.S. Pat. Nos. 5,226,849 and D. 392,419. The current invention employs a modified first lever which is relatively shorter than the first lever in prior art common nail clipper designs, and which first bends upwardly at a more extreme angle than in prior art common nail clipper designs and then curves downwardly before straightening out so that its end is largely parallel to the cutting arm springs of the nail clipper. The current invention adds a second lever arm assembly which pivots on a hinge that is integrated and attached to both cutting arm springs at the end opposite their cutting edges. The addition of the second lever arm assembly, along with the modified first lever, together result in the current invention's improved usability and its differentiation from the prior art. U.S. Pat. No. 4,176,449 employs a similar design which envelops an unmodified common nail clipper of prior art in a two part hinged apparatus that includes a second lever arm to press down on the lever of the enveloped common nail clipper of prior art. The device described in U.S. Pat. No. 4,176,449 uses a second lever with a U-shaped cross-section that does not allow the first lever to pass through it. This design requires the hinge point for the second lever to be considerably further away from the nail clipper's cutting edges than the ends of a common nail clipper's cutting arms are so that the angle at which the common nail clipper's lever hits the second lever is acute enough to allow it to slide along the second lever as the second lever is rotated towards the clipper's cutting edges during use. This device requires a second damping bar to be riveted to the end of the common nail clipper to extend the common nail clipper's cutting arms so that the longer second lever can be hinged to the damping bar at the end farthest from the common nail clipper's cutting edges. This results in a device that is considerably longer than a common nail clipper which violates one of the goals of the current invention. Further, the current invention differentiates from this design in quietness and smoothness of operation as in its preferred embodiment it employs a roller on a pivot pin that spans the two vertically-oriented side bars of its second lever assembly, to smoothly roll along the first lever as the second lever rotates towards the nail clipper's cutting edges.

Alternate prior art function using a scissors-like action that doses the cutting edges. Some of these designs are relevant as their goal is similar to the current invention. These designs, covered by U.S. Pat. Nos. 741,709 and D629,161 S, add a lever arm to the scissors-like design that allows the user to apply pressure dose to the location of the cutting edges in a manner similar to the current invention. While this design is similar to the current invention in that they share the goal of allowing the user to apply force dose to the cutting action, the scissors-like cutting action is different from the current invention's cutting action.

SUMMARY OF THE INVENTION

Traditional fingernail and toenail clippers require a user to apply pressure to the clipper's levers/handles at the end opposite the cutting edges. The current invention reverses this to allow the user to apply force dose to the cutting edges, thereby making the tool more ergonomically correct and easier to use. The current invention takes the traditional nail clipper design and adds a second lever arm assembly that rotates on a pivot point attached to the edge of the cutter arms at the end opposite the cutting edges. The additional lever arm assembly is shaped such that when pushed down by the user it will push down on the clipper's other lever arm which causes the cutting edges to dose together and to dip the nail.

DESCRIPTION OF THE PREFERRED EMBODIMENT

Figure 1:
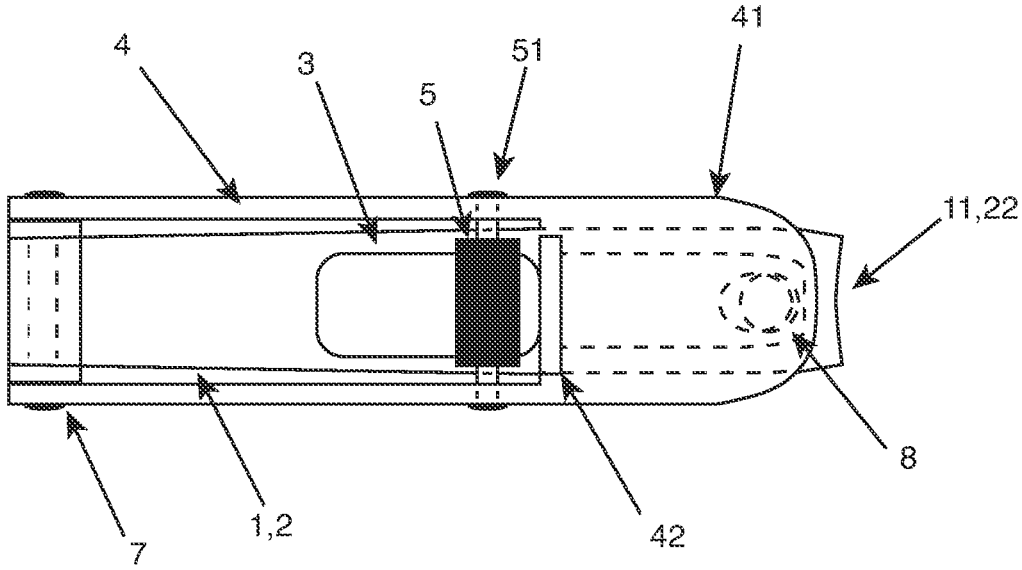
FIG. 1 is a top plan view of the clipper with items that would not be visible shown as dotted lines.
Figure 2:
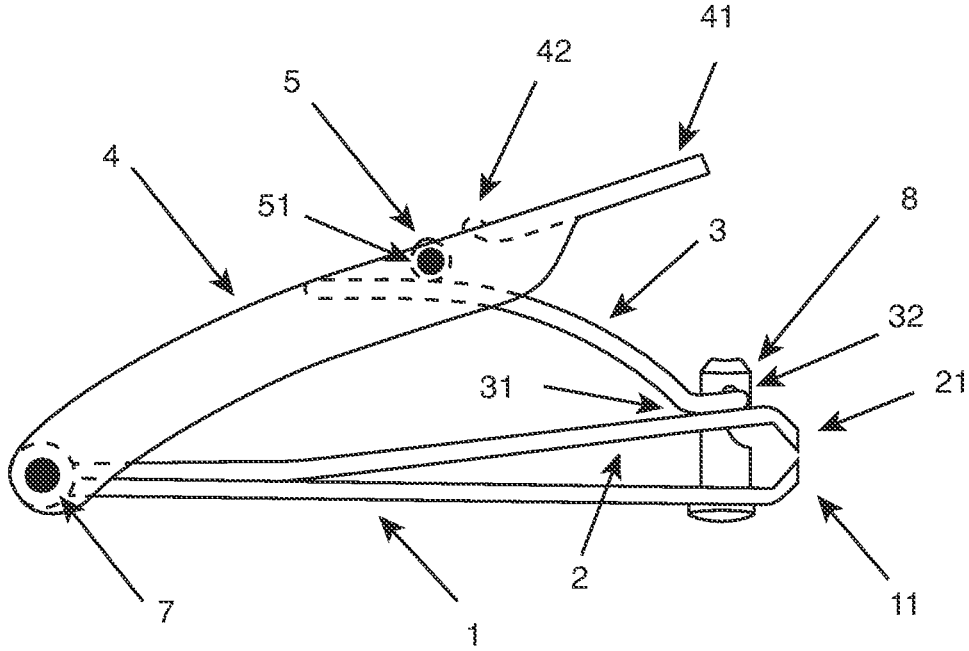
FIG. 2 is right side elevational view of the clipper with items that would not be visible shown as dotted lines.
Figure 3A:
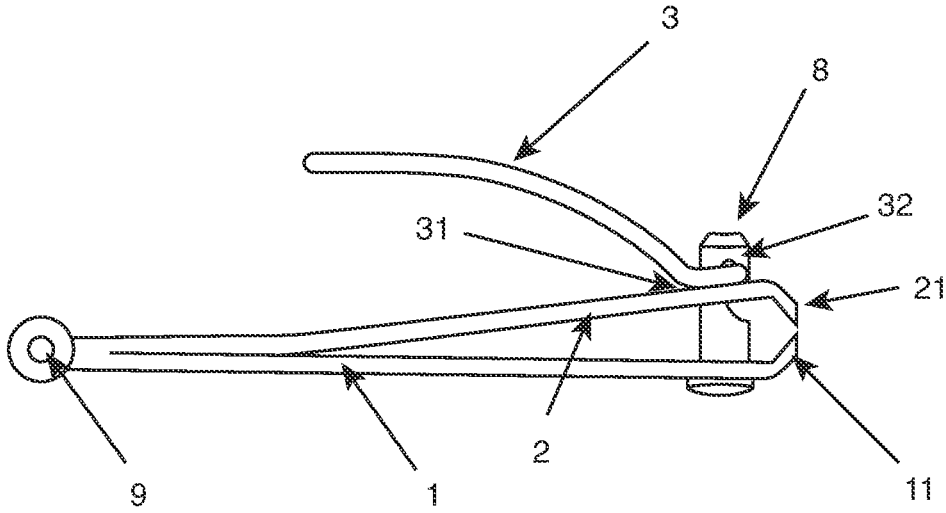
FIG. 3*a* is a right side elevational view of the clipper without its second lever/handle attached to the clipper.
Figure 3B:
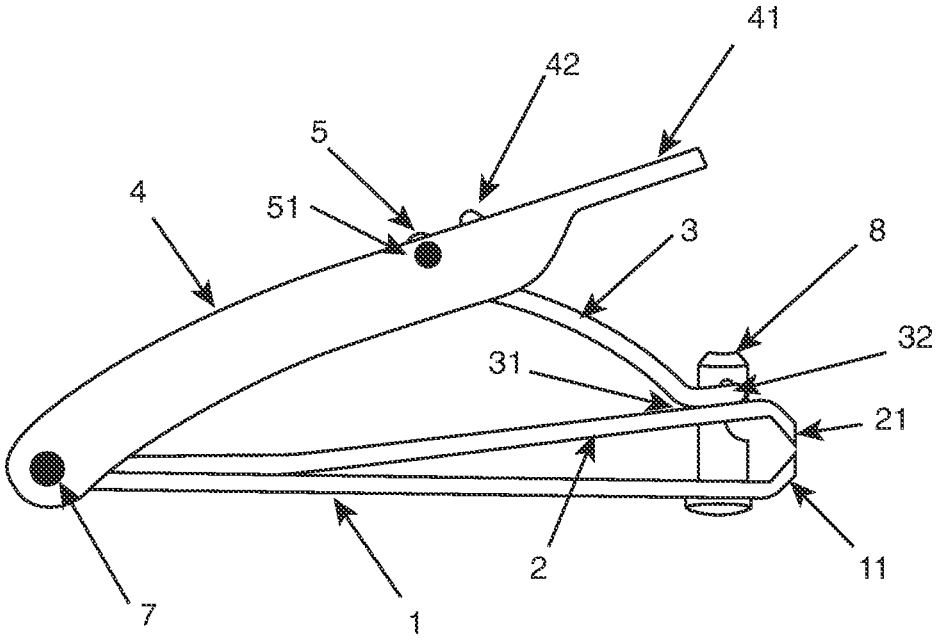
FIG. 3*b* is a right side elevational view of the clipper.

Referring now to the drawings, and more specifically to FIG. 2, the user presses downward on what has heretofore been referred to as the second lever assembly, 4, at thumb pad, 41, located at the end of the second lever opposite it's fulcrum, 7, and above the cutting edges, 11 and 21. In one manner of operation the user's thumb will be positioned on the thumb pad, 41, of the second lever assembly, 4, while the user's fingers will be underneath the lower cutting arm spring, 1, supporting the nail clipper, and with their index finger closest to the cutting edges, 11 and 21. When the user presses their thumb towards their index finger, the thumb pad 41 moves down towards the cutting edges, 11 and 21, while the second lever assembly, 4, rotates about its fulcrum, 7. This downward movement causes either the roller, 5, or the upwardly curved surface, 42, of the second lever assembly, 4, to press down on the nail clipper's first lever, 3. This causes the first lever, 3, to move down and rotate around its far end, 32, which serves as an integrated fulcrum as it engages in the slot of the support and pivot pin, 8, hereafter referred to as the support pin. The support pin, 8, remains fixed while applying upward pressure on the lower cutting arm spring, 1, while the first lever, serving as a second class lever, rotates counter-clockwise, when viewed Thorn the right side of the clipper, which causes the first lever, 3, to press down on the upper cutting arm spring, 2, where the bend, 31, in the first lever presses onto the upper cutting arm spring, 2. Together these actions cause the upper cutting arm spring, 2, to flex down and towards the lower cutting arm spring, 1, thereby dosing the gap between the cutting edges, 11 and 21, until they meet and cut a fingernail or toenail.

In the preferred embodiment of the invention, a roller, 5, rotates around a shaft pin, 51, which is secured to the two vertical sides of the primary lever, 4, across its open section. The roller, 5, presses down on and rolls along the secondary lever, 3, as the user presses down on the thumb pad, 41, of the primary lever, 4. The invention also functions similarly if the roller, 5, and its shaft pin, 51, are not present as the curved edge, 42, of the primary lever, 4, will also press against and slide along the secondary lever, 3, as the user presses down on the thumb pad, 41, of the prim y lever, 4, and executes a nail dipping action.

Figure 4A:
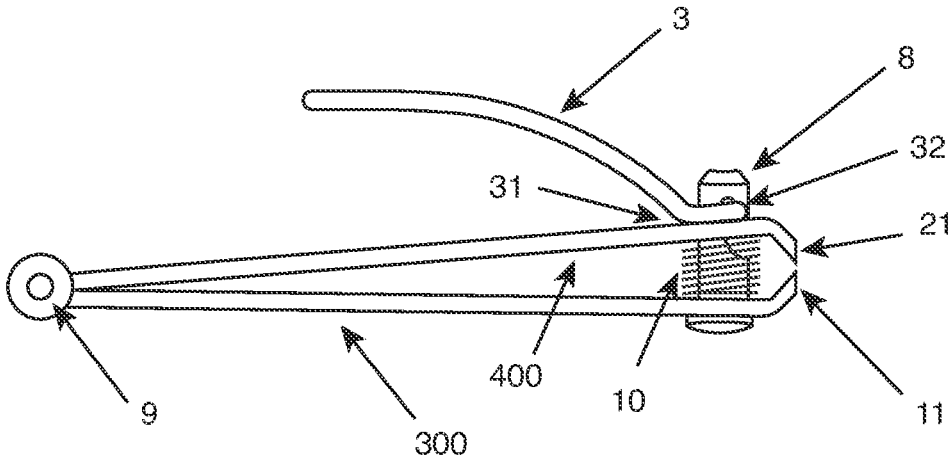
FIG. 4*a* is a right side elevational view of a modified version of the clipper without its second lever/handle attached to the clipper.
Figure 4B:
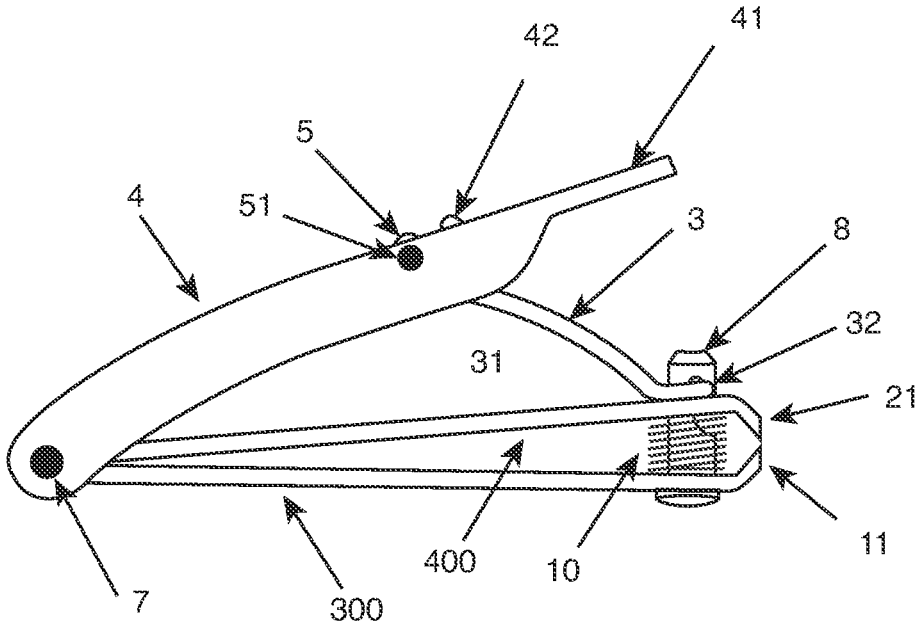
FIG. 4*b* is a right side elevational view of a modified version of the clipper that uses a coil spring to separate its cutting edges.

In FIGS. 4*a* and 4*b*, the upper and lower cutting arm springs, 1 and 2, in the other drawings, are replaced by simple lower and upper cutting arms, 300 and 400 respectively, which each are joined by and rotate about the pivot pin 7 at the rear or far end of the nail clipper. In this embodiment of the invention, the cutting arms, 300 and 400, and cutting edges, 11 and 21, are held apart by a coil spring 10 resting around the support pin 8 and between the cutting arms. The spring compresses when the nail clipper is cutting a nail, and it pushes the cutting arms and the cutting edges apart when the user releases pressure on the primary lever.

Figure 5:
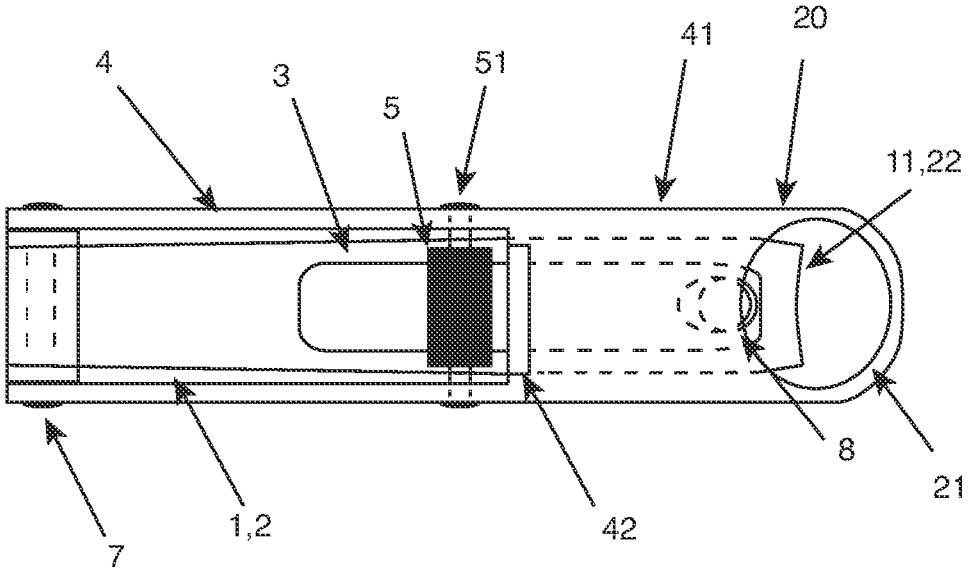
FIG. 5 is top plan view of the clipper with an integrated magnifying lens and frame above the cutting edges.

In FIG. 5 a magnifying lens, 21, made from plastic or glass, sits in a frame, 20, that attaches to the thumb pad, 41 and extends from it over the clipping edges, 11 and 21. It would remain in the spirit of the invention for this magnifying lens and frame to incorporate a small light source, such as an L.E.D. bulb, to illuminate the front of the nail clipper and the user's fingernail or toenail.

Figure 6:
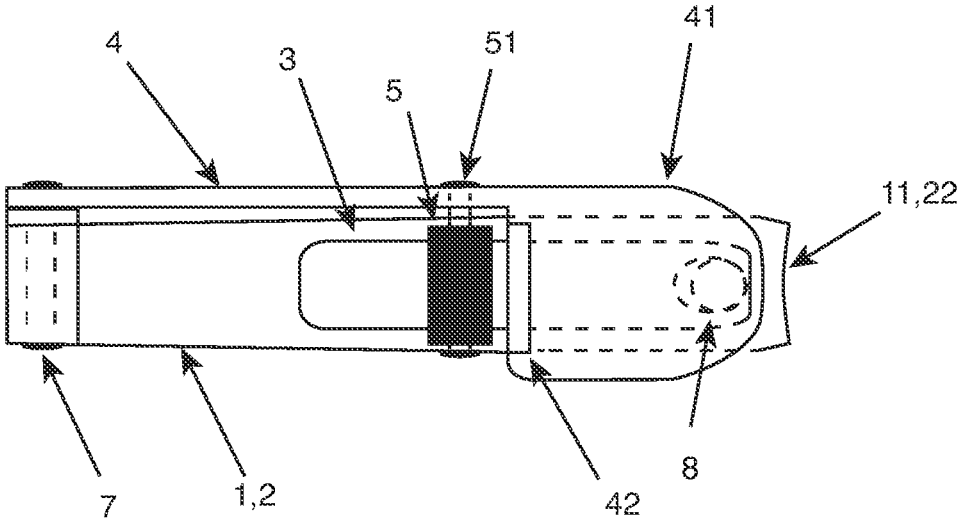
FIG. 6 is a top plan view of the clipper with a second lever assembly that includes only one vertically oriented bar on one side of the nail clipper instead of two parallel vertically-oriented bars on each side of the nail clipper.

In FIG. 6 the nail clipper is shown with only one vertically-oriented bar as part of the second lever assembly, 4, and a more rigid shaft bolt, 51, replacing the shalt pin in the other drawings.

The invention claimed is:

1. The invention of a new and improved fingernail and toenail clipper comprised of two cutting arms with cutting edges at one end and joined at tile other end where a cylindrical barrel is also attached to serve as a hinge joint; and wherein at the front end close to the cutting edges, a support and pivot pin penetrates through both cutting arms and extends out the top where it engages a loose primary actuating lever which is shaped to seat in a notch in the support and pivot pin allowing it to rotate around the support and pivot pin and to lie in a somewhat flat position on the top cutting arm when closed and to close the cutting edges when in the open position; and wherein the primary actuating lever has a sharp upward bend, when in the open position, just back of the support and pivot pin and it curves downward to end in a flat portion that is nearly parallel to the top cutting arm and ending at a point above the cutting arms; and wherein a second lever assembly rotates about a pin running through the lever assembly at its rear end and through the hinge joint at the end of the cutting arms;

the second lever assembly includes a horizontally oriented thumb pad; and a horizontally-oriented roller sits on a shaft pin that spans the second lever assembly behind the thumb pad and resting on the primary actuating lever which passes under it.

2. The invention of claim 1 further including one vertically-oriented bar on the second lever assembly and having the thumb pad cantilevered out and from it and the roller sitting on a shaft bolt cantilevered over the primary actuating lever.

3. The invention of claim 1 or 2 further including a magnifying lens attached to and extending forward from the thumb pad over the cutting edges to enable users to see a magnified view of their fingernail or toenail when positioning the nail clippers.

* * * * *